US009192257B2

(12) United States Patent
Baker

(10) Patent No.: US 9,192,257 B2
(45) **Date of Patent: *Nov. 24, 2015**

(54) CUP AND LID FOR PERSONS WITH DRINK DIFFICULTIES

(71) Applicant: Janet Baker, Westfield, MA (US)

(72) Inventor: Janet Baker, Westfield, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/562,830

(22) Filed: Dec. 8, 2014

(65) Prior Publication Data

US 2015/0108149 A1 Apr. 23, 2015

Related U.S. Application Data

(63) Continuation-in-part of application No. 14/058,377, filed on Oct. 21, 2013, now Pat. No. 8,925,760.

(51) Int. Cl.
*A47G 19/22* (2006.01)

(52) U.S. Cl.
CPC ..... *A47G 19/2266* (2013.01)

(58) Field of Classification Search
CPC ..... A47G 19/2272; A47G 19/2266; A47G 19/2205; B65D 55/165; B65D 55/16
USPC ..... 220/713, 711, 710.5, 375, 293, 288, 220/200; 215/306, 276, 274, 273; 222/568, 222/567, 566, 544; 53/490, 485; D9/446
See application file for complete search history.

(56) References Cited

U.S. PATENT DOCUMENTS

| | | | | |
|---|---|---|---|---|
| 2,581,849 | A * | 1/1952 | Fisch | 220/288 |
| 5,147,066 | A * | 9/1992 | Snider | 220/717 |
| 2002/0179614 | A1* | 12/2002 | Rohlfs | 220/713 |
| 2004/0056040 | A1* | 3/2004 | Ziegler | 220/847 |
| 2006/0231559 | A1* | 10/2006 | Allen | 220/501 |

* cited by examiner

*Primary Examiner* — Robert J Hicks
(74) *Attorney, Agent, or Firm* — Bernard P. Molldrem, Jr.

(57) ABSTRACT

A cup for persons with tremors, or other difficulty holding the cup steady, has a lid with an opening from which to drink, to prevent spilling or splashing. The lid is removably attached by a strap or band to the neck or rim of the associated cup. The cup, lid, and strap are all formed of a durable, food-grade plastic material. The strap has a ring that fits over the neck of the cup and can be rotated on and off. This arrangement allows the cup and lid to remain attached through a wash cycle and during storage.

5 Claims, 2 Drawing Sheets

CUP AND LID FOR PERSONS WITH DRINK DIFFICULTIES

This is a Continuation-in-Part of my co-pending patent application U.S. application Ser. No. 14/058,377, filed Oct. 21, 2013, now U.S. Pat. No. 8,925,760, Jan. 6, 2015.

BACKGROUND OF THE INVENTION

This invention relates to beverage containers, of the type that may include sip cups or sipper cups, which have a lid with a sip spout to limit the flow of liquid for a individuals drinking from the cup. The invention is more specifically concerned with washable and reusable cups that facilitate keeping the mating lid with the associated cup, so that the lid and cup remain together through washing and storage.

The invention is particularly concerned with a sip cup intended for individuals that have a swallowing difficulty. These persons are often found in an elder care facility or an assisted care residence. A problem can arise in these facilities when the lids get separated from the drink containers in the kitchen area, and the one that fits a given cup often is not found. Currently the lids get lost or discarded, and as a result the persons with swallowing difficulty are given a cup with no lid. Use of an open cup when use of a sip cup has been recommended can result in swallowing problems such as aspirating of the liquid, choking, or worse.

Other individuals who may not have swallowing problems but have difficulty in holding a drink cup because of shaking issues, e.g., Parkinson's disease sufferers, may require a lid for their drink cups to avoid splashing or spilling, but do not need a sip lid. However, the same problem arises that there are not always lids available because they have been lost.

Current sip cups do not have separate lids that are attached to the cup. The lids themselves are lightweight, too light to be washed in a typical institutional dishwasher and stay in the location they are placed. The lids are often moved off the rack by the surging water during the wash and rinse cycles, and these can end up near the heating elements where they are destroyed by heat during the drying cycle. The lids can also be lost or damaged for many other reasons.

For many individuals with swallowing problems, e.g., dysphagia, the use of sip cups is imperative for maintaining swallowing safety and for preventing patients from aspirating or choking The main purpose of the sip cup, from the standpoint of a speech-language pathologist, is to help control the size of the sip that an individual can take. Sip cups are also used for individuals exhibiting an uncontrollable tremor, e.g., individuals with Parkinson's disease, who may spill drinks frequently, but in many cases these patients do not have the same swallowing problems, and can be given a cup with a simple drink opening instead of a spout.

The care providers, e.g., nurses, and non-clinical staff members, e.g., nurses' aids, often do not understand the importance of providing individuals with covered sip cups as recommended by speech pathologists and occupational therapists. When no lids are available, these care providers often provide drinks to the individual in cups with no sip cup lid. This inadvertently places the patient at risk for possible aspiration, which may result in aspiration pneumonia or choking, which may result in serious injury or death. Moreover, because they lack an understanding of the purpose and importance of the use of sip cups for patients with dysphagia, staff members and family members alike often dispose of the sip cup lids, creating an increasing shortage.

This problem appears to be system wide, and not simply a problem that appears in a few scattered hospitals or care facilities.

Ideally, individuals will be provided with sip cups several times a day, i.e., for medication passes, nourishment passes (morning and afternoon), at three meals each day, and any other time in which one of those individuals may wish to have a beverage during the day. Lack of the appropriate equipment places every affected patient at high risk for medical complications. In addition, the failure to have sip cups available can place the facility itself at risk of non-compliance with government health department inspections, specifically for being out of compliance with a physician's order, or speech therapist's or occupational therapist's recommendations.

For some patients without swallowing problems but who may have difficulty in holding a drink cup steady, drink cups with lids that have a simple opening in the lid, but not sip spouts, may be required. Here, the lid is needed because of spilling or splashing issues. In these cases also cups are often missing their lids because the lids have become separated from the cups and then lost.

OBJECTS AND SUMMARY OF THE INVENTION

Accordingly, it is an object to provide sip cups or other lidded cups which avoid the problems of the prior art, more specifically to provide sip cups or other cups with permanent lids which can remain with the associated cup when detached, and which will remain with the cup throughout washing and storage.

A more specific object of this invention is to provide a sip cap or other lid with a strap that fits onto the neck or top of the cup or container, so that the lid stays with the cup. The lid and strap and cup are all made of a synthetic material, e.g., a tough food-grade plastic resin, that can withstand the institutional dishwashing process many times. The neck of the container can be push-on, snap-on or screw-on, and the strap can have a ring that fits securely onto the neck of the associated container. The lid stays attached to the cup by the strap, and the lid and cup can be run together through the dishwasher. When needed, the ring can be pulled or screwed off the neck of the container or cup to separate the lid from the cup.

According to an aspect of the present invention, a washable and re-useable cup, designed for persons with a swallowing disorder or who may suffer from tremors, comprises a cup, a lid, and a retaining strap.

The cup has a side wall, a bottom, and a neck extending upward from the side wall ending at a rim or top. Retaining structure on the neck at or near the rim, e.g., male screw threads or a push-on retaining bead, protrudes radially out from the neck and extends around the periphery of the neck.

The lid has a top and a side wall descending from the top and dimensioned to fit onto the neck of the associated cup. There is mating retaining structure on an inner side of the side wall of the lid to fit over and engage the retaining structure on the neck of the cup. This secures the lid onto the neck of the cup, but the lid can be twisted (rotated) off or pulled off. For dysphagic patients, a sip spout extends upward and is angled outward from the top of the lid. This spout permits the person to sip liquid from the cup. For other patients a small opening in the lid allows the user to drink from the cup, but the lid helps prevent undesired spilling due to the user's difficulty in holding the cup.

The retaining strap secures the lid to the cup so that the lid and cup remain connected to one another during washing and storage. Here, an elongated flexible band has a first end connected to the lid and a second end at which a ring is formed. The ring has an inner dimension that matches the diameter of the neck but does not exceed the diameter of the retaining structure at the rim of the neck, such that the ring can be slipped or rotated over the retaining structure onto the neck and can be removed by rotating it or pulling it off. The ring will remain on the neck of the cup during normal use and during washing and storage.

The cup, lid, and strap are most favorably formed of a durable food-grade plastic resin.

The retaining structure on the neck can include male threads or can include a peripheral bead protruding out along the rim of the neck.

In preferred embodiments, the first end of the band ends in a ring member, and the lid includes a stem onto which the ring member is rotatably fitted. This allows the lid to be twisted on or off without the strap having to rotate on the cup.

In many sip cup embodiments, the sip spout can be in a fixed position on the lid, but in other possible embodiments, the sip spout may be pivotally mounted on said lid so that it can be tipped up for use and tipped down for storage.

These and other objects, features, and advantages of the invention will become apparent from the following detailed description of selected preferred embodiments, which is to be read in connection with the accompanying Figures of Drawing:

DETAILED DESCRIPTION OF THE PREFERRED EMBODIMENT

Figure 1:
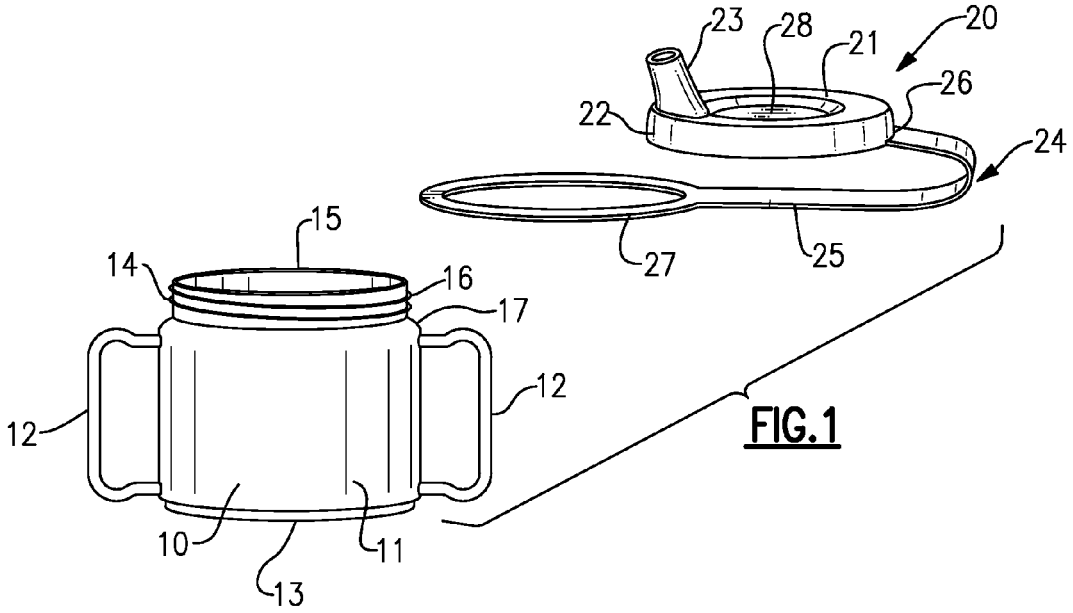
FIG. 1 is a perspective assembly view of the sip cup according to an embodiment of this invention.
Figure 2:
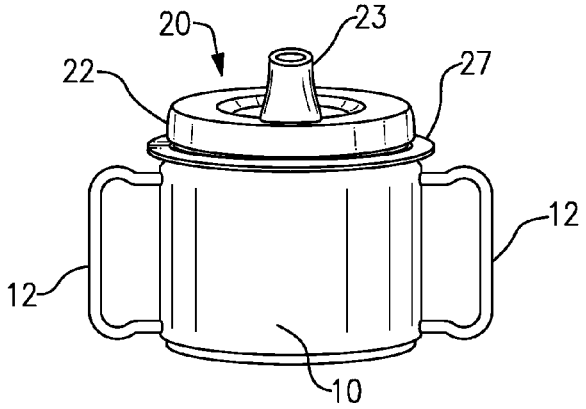
FIG. 2 is a front elevational view of the sip cup of this embodiment.
Figure 3:
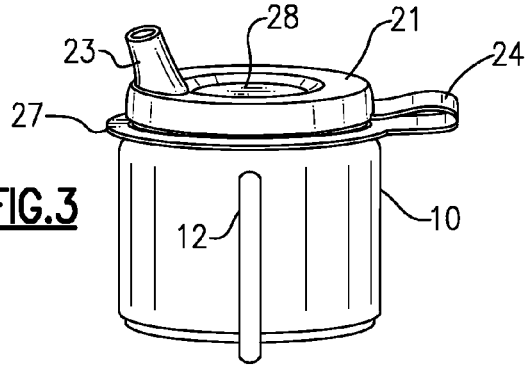
FIG. 3 is a side elevational view of the sip cup of this embodiment.

With reference to the Drawing Figures, and initially to FIGS. 1 to 3, a sip cup that embodies the features of this invention has a cup or drink container 10 with a cylindrical or generally cylindrical side wall 11, one or more handles 12, each formed unitarily with the side wall 11 of the cup, and which are large enough so that the person can grip each handle with all fingers, a base or bottom 13, and a neck 14 that extends up from the side wall and ends at an upper rim 15. Here a male screw thread 16 is present on the neck as structure for retaining the associated lid 20 when it is screwed on. The outer ridge of the thread defines a diameter of the male thread. The neck 14 is of smaller diameter than the side wall, so that a shoulder 17 of larger diameter than the neck is defined between the neck and the side wall where the neck emerges from the upper part of the side wall.

The lid 20 has a top or disk 21 with a generally cylindrical skirt 22, i.e., side wall with female threads (not shown) that mate with the male thread 16 of the container neck 14. A sip spout or nipple 23 (which can be fixed as shown here or pivoting) is positioned at one side of the lid and is favorably tilted outward to facilitate drinking.

A retaining strap 24 is affixed at one end to the lid and connects the cup with the lid. The retaining strap 24 is formed as an elongated flexible band 25 with the one end 26 fastened to the lid 20 (so that the strap remains attached to the lid during use and cleaning) and with a ring 27 formed at its other end. The ring 27 as illustrated here has an inner diameter just larger than the diameter of the neck 14, but less than the diameter of the male thread 16, so that the ring can screw on and off the neck by rotating the ring 27. Thus the ring 27 is configured so as to require the user to spin the ring 27 around the neck of the cup when it is needed to remove the lid 20 and strap 24 from the cup 10, but the strap and lid will remain in place on the cup until the strap is deliberately spun or rotated off by the user. Not shown here is a small air vent in the lid on the side away from the spout 23 or other drink opening, which the person of ordinary skill would know to include on the lid.

As shown in FIGS. 2 and 3, the top 21 of the lid 20 may have a recessed or concave portion 28 to accommodate the nose of the person, to facilitate ease of drinking.

Figure 4:
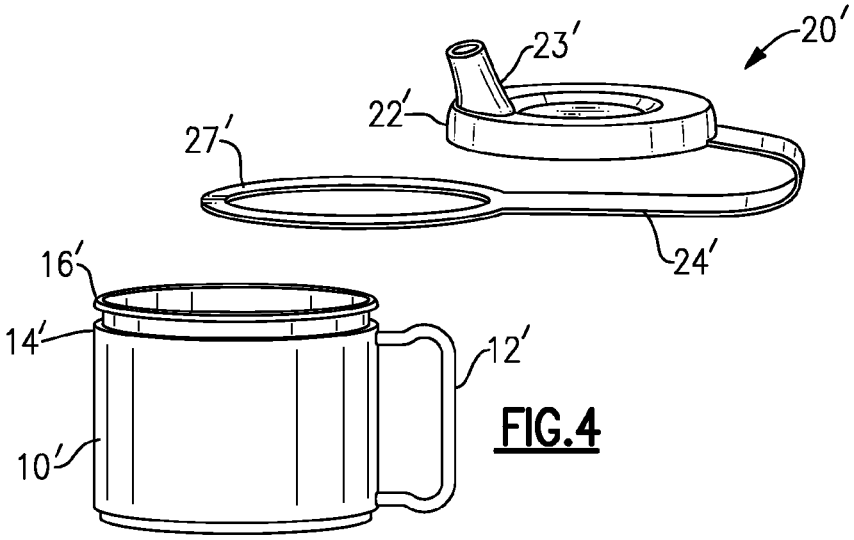
FIG. 4 is a perspective assembly view of the sip cup according to another embodiment of this invention.

A second embodiment of the sip cup 10' is shown in FIG. 4, in which elements that correspond to like elements in the first embodiment are identified with similar reference numbers but primed. The lid or cap 20' and strap 24' are similar to those of the first-described embodiment. Here the cup 10' is designed for a snap-on lid, and has a retaining bead 16' or annulus disposed at the upper rim of the neck 14', and the lid 20' has matching snap-on retaining structure (not shown) inside the skirt or side wall 22'. In this case, the ring 27' of the retaining strap 24' also can be pulled over the bead 16' to keep the lid with the associated cup, but can be pulled off from the neck 14' of the cup if it is needed to separate the lid and cup.

Figure 5:
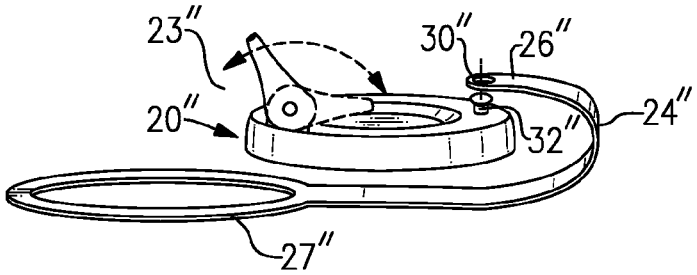
FIG. 5 is a perspective assembly view of the sip cup according to a further embodiment of this invention.

FIG. 5 illustrates another embodiment, in which similar elements are identified with the same reference numbers as used on the first and second embodiments, but with a double-prime. In this embodiment, the strap 24" is rotatably fitted onto the cap or lid 20". A second, small ring 30" formed at the end 26" of the band fits over a stem or post 32" that protrudes upward from the lid 20". There may be a bulging or rounded retaining button formed at the top of the stem 32". The stem 32" can be situated at a central part of the lid, or may be formed near one edge of the lid. Here, the associated cup is not shown.

Also in this embodiment, the spout 23" is mounted to the lid 20" on a horizontal pivot, so that it can be tipped back for storage and tipped up for use.

Figure 6:
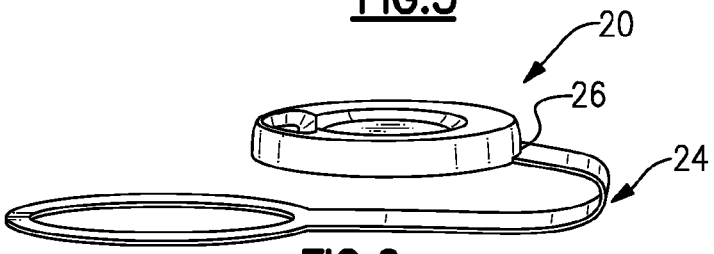
FIG. 6 is a perspective view of the lid with retaining strap and ring according to another embodiment.
Figure 7:
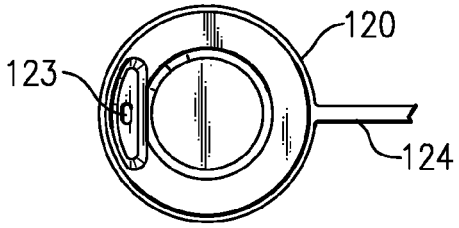
FIG. 7 is a top view of the lid of FIG. 6.

FIGS. 6 and 7 show a lid 120 with attached strap 124 and ring 127, similar in most respects to the lid and straps shown and described in respect to the embodiments of FIGS. 1 to 4, except that the lid 120 is provided with a simple drink opening 123 instead of a sip spout. This lid is intended for use on cups of the type shown in the embodiments of FIGS. 1 and 4, with the ring 127 rotating on and off over the male threads 16 of the cup in the manner described above. This resolves the issue of loss of lids from the cups after the cups have been used and have been returned for washing.

While the present invention has been described with reference to certain preferred embodiments, it should be understood that the invention is not limited to those precise embodiments. Rather, many modifications and variations would present themselves to persons skilled in the art without departure from the scope and spirit of this invention, as defined in the appended claims.

What is claimed is:

1. A washable and re-useable cup for a person, comprising:

a cup having a side wall, a bottom, and a neck extending upward from said side wall ending at a rim, wherein said neck and said side wall define a shoulder portion at a top of said side wall such that the shoulder portion extends radially outward beyond said neck; with retaining structure on said neck at said rim protruding radially out from said neck and extending around the periphery of said neck, wherein said retaining structure on said neck includes at least one male thread spiraling around said neck with an outer ridge that projects radially out beyond said neck defining a diameter of said male thread;

a lid having a top, a side wall descending from said top and dimensioned to fit onto the neck of said cup, including retaining structure on an inner side of the side wall of said lid to fit over and engage the retaining structure on the neck of the cup for releasably holding the lid onto the neck of the cup, and a drink opening on the lid at or near a rim of the lid to permit the person to sip liquid from said cup; and a retaining strap affixed at one end to said lid for securing the lid to the cup so that the lid and cup remain connected to one another during washing and storage; including an elongated flexible band having a first end connected to said lid and a second end, with a ring being formed at said second end, the ring having an inner dimension that matches the diameter of the neck but is less than the diameter of said male thread, such that said ring is configured so that it can be rotated over the male thread on said neck to said shoulder and can be removed from said neck only by rotating it off but will remain on said neck during normal use and during washing and storage.

2. The cup according to claim 1 in which the cup, lid, and strap are each formed of a food grade plastic resin.

3. The cup according to claim 1 wherein the retaining structure on said neck includes plural male threads.

4. The cup according to claim 1 wherein said first end of said band ends in a ring member, and said lid includes a stem onto which said ring member is affixed over said stem so as to be rotatable.

5. The cup according to claim 2, wherein said food grade plastic employed in the cup, lid, and strap are of sufficient durability to endure repeated use, and the temperature and washing forces of dishwashing machines.

* * * * *